United States Patent [19]

Beeckmans

[11] 4,194,971

[45] Mar. 25, 1980

[54] METHOD OF SORTING FLUIDIZED PARTICULATE MATERIAL AND APPARATUS THEREFOR

[75] Inventor: Jan M. Beeckmans, London, Canada

[73] Assignee: Canadian Patents & Development Limited, Ottawa, Canada

[21] Appl. No.: 939,811

[22] Filed: Sep. 5, 1978

[30] Foreign Application Priority Data

Sep. 13, 1977 [GB] United Kingdom ..... 38112/77

[51] Int. Cl.[2] ..... B03B 4/00

[52] U.S. Cl. ..... 209/467; 209/476; 34/57 A

[58] Field of Search ..... 209/467, 476, 472, 474, 209/476, 466, 468, 469, 475, 480, 481, 492, 11; 34/10, 57 A, 57 D

[56] References Cited

U.S. PATENT DOCUMENTS

| | | | |
|---|---|---|---|
| 1,944,643 | 1/1934 | Holmes | 209/467 |
| 2,310,894 | 2/1943 | Brusset | 209/467 |
| 3,815,255 | 6/1974 | Yamato | 34/57 D |

OTHER PUBLICATIONS

Muzyka et al., Solids Separation in a Counter-Current Fluidized Cascade: Jetsam-Rich Mixtures at Total Reflux, Canadian, Journal of Chemical Engineering, vol. 56, Jun. 1978, 286-291.

*Primary Examiner*—Robert Halper
*Attorney, Agent, or Firm*—Francis W. Lemon

[57] ABSTRACT

Fluidized particulate material in an elongated fluidizing bed is separated by means of paddles, on an endless chain running around sprockets, urging at least an upper portion of the fluidized bed towards one end of the bed to enrich that end with lighter particles and the other end with heavier particles. The particles thus separated are removed from the ends of the bed by, for example, flowing over weirs. In one embodiment only the paddles passing along the underside of the chain dip into the fluidized bed while in another embodiment the whole chain and all of the paddles are immersed in the fluidized bed.

2 Claims, 7 Drawing Figures

METHOD OF SORTING FLUIDIZED PARTICULATE MATERIAL AND APPARATUS THEREFOR

This invention relates to a method of sorting fluidized particulate material and apparatus therefor.

It is known from, for example, U.S. Pat. No. 2,586,818, dated Feb. 26, 1952, "Progressively Classifying or Treating Solids in a Fluidized Bed Thereof," V. Harms, to sort particulate material into finer and coarser particles by fluidizing a bed of the particulate material in a container to segregate the bed into stratified layers of finer and coarser particles, and then to separate the particles by withdrawing the stratified layers from the fluidized bed through different discharges from the container. This fluidized bed, stratified layer separation, while useful has a limited use in that it cannot separate particles efficiently.

It is also known from, for example, U.S. Pat. No. 3,444,996, dated May 20, 1969, "Dry Separation of Mixtures of Solid Materials," E. Douglas and T. Walsh, to separate solids of different densities using the float-and-sink principle of separation in which instead of a liquid separating medium a solid separating medium in particulate form, fluidized by the introduction of low pressure air or other gaseous material into a mass of such medium, is employed to effect separation within the mass, and vibration of the mass and/or cycling of separating medium from and to the mass is utilized to cause the separated fractions to follow different paths towards spaced outlets. This process, while useful, has a disadvantage in that extraneous particles of the solid separating medium in particulate form are introduced and tend to contaminate the products. Also the feed particles must be coarser than fluidizing medium particles in order to be screened therefrom and this puts a limitation on the usefulness of this process.

According to the present invention there is provided a method of sorting fluidized particulate material which comprises:

(a) feeding particulate material to an elongated, horizontally extending container having a gas permeable base and at least a major, intermediate lengthwise extending portion of the interior thereof unobstructed for the flow of fluidized particulate material towards both a first end and a second end thereof, (b) fluidizing a bed of the particulate material in the container, (c) moving at least paddles attached to a lower side of a looped endless flexible member along the container and through the said at least major intermediate lengthwise extending portion only of the fluidized bed so that an upper portion of the fluidized bed is moved towards the first end while a lower portion of the fluidized bed is moved towards the second end thereby causing a progressive enrichment of the fluidized bed in lighter particles towards the first end with reflux of lighter particles therefrom, and a progressive enrichment of the fluidized bed in heavier particles towards the second end with reflux of heavier particles therefrom, (d) removing particulate material from the first end, and (e) removing particulate material from the second end.

In some embodiments of the present invention all of the paddles on the endless flexible member are moved through the fluidized bed so that the paddles on the upper side of the loop of the endless member move through an upper portion of the fluidized bed towards the first end while the paddles on the lower side of the loop of the endless member move through a lower portion of the fluidized bed towards the second end.

Further according to the present invention there is provided a fluidized particulate material sorting apparatus, comprising:

(a) a particulate material fluidizing container which is elongated in a horizontal direction and has a base which is gas permeable over substantially the whole area thereof for fluidized particulate material above the gas permeable base, at least a major intermediate lengthwise extending portion of the interior thereof unobstructed by the container for the flow of fluidized particulate material therealong, and an upper gas outlet thereof, (b) means for feeding particulate material to the container, (c) means for removing particulate material from a first end of the container, (d) means for removing particulate material from the second, other end of the container, (e) means for feeding pressurized gas to substantially the whole area of the underside of the base, and wherein the improvement comprises, (f) an endless flexible member, (g) mounting means around which the endless flexible member is looped at each end with at least a lower side of the loop extending only along the said at least major, intermediate, lengthwise extending portion of the container interior for movement therealong, (h) a plurality of paddles extending across at least a major portion of the container interior and facing the first and second ends and distributed along the length of the endless flexible member and attached thereto so that, in operation, the paddles along at least one side of the loop will be at least partially immersed in a fluidized bed in the container, and (i) driving means for driving the endless flexible member around the mounting means in a direction to move the said paddles along the container at a speed, whereby in operation, (j) a progressive enrichment of the fluidized bed in lighter particles occurs towards the first end, and a progressive enrichment of the fluidized bed in heavier particles occurs towards the second end with reflux of lighter particles therefrom.

In the accompanying drawings which illustrate, by way of example, embodiments of the present invention, FIG. 1 is a diagrammatic side view of a fluidized particulate material sorting apparatus, FIG. 2 is a schematic side view of the main parts of an experimental apparatus used to test the feasibility of the apparatus shown in FIG. 1, FIGS. 3 to 5 are graphs of the experimental results obtained using the apparatus shown in FIG. 2 to sort carbon from sand, FIG. 6 is a diagrammatic side view of a different embodiment of the fluidized particulate material sorting apparatus to that shown in FIG. 1, and FIG. 7 is a diagrammatic side view of yet another different embodiment of the fluidized particulate material sorting apparatus to that shown in FIG. 1.

Referring to FIG. 1 there is shown a fluidized particulate material sorting apparatus, comprising:

(a) a particulate material fluidizing container 1 which is elongated in a horizontal direction and has a base 2 which is gas permeable over substantially the whole area thereof at least a major, intermediate lengthwise extending portion of the interior thereof unobstructed for the flow of fluidized particulate material therealong, and an upper gas outlet 4, (b) means in the form of a particulate material hopper 5 for feeding particulate material to the container 1, (c) means in the form of a first outlet 6 and a chute 56 for removing particulate material from a first end 8 of the container 1, (d) means in the form of a second outlet 10 and a chute 60 for removing particulate material from the second, other end 12 of the container 1, (e) means generally designated 14 for feeding pressurized gas to substantially the whole area of the underside 16 of the base 2, and wherein the improvement comprises, (f) an endless flexible member in the form of a chain 18, (g) mounting means, in the form of sprockets 20 to 23 around which the chain 18 forming the endless flexible member is looped adjacent each end 8 and 12 with at least a lower side of the loop extending only along the said at least major, intermediate, lengthwise extending portion of the interior of the container 1 for movement therealong, (h) a plurality (in this embodiment fourteen) of paddles 24 to 37 extending across at least a major portion of the container interior and facing the first and second ends 8 and 12 respectively and distributed along the length of the chain 18 forming the endless flexible member and attached thereto so that, in operation, the paddles 24 to 37 along at least one side 38 of the loop will be at least partially immersed in a fluidized bed in the container 1, and (i) driving means in the form of an electric motor 40 for driving the chain 18 forming the endless flexible member around the sprockets 20 to 23 forming the mounting means in a direction Z to move the paddles 24 to 37 along the container 1 at a speed, whereby, in operation, (j) a progressive enrichment of the fluidized bed in lighter particles occurs towards the first end 8 with reflux of heavier particles therefrom, and a progressive enrichment of the fluidized bed in heavier particles occurs towards the second end 12.

The gas permeable base 2 is a false bottom in the container 1 and is spaced from the real bottom 42 by baffles 44 to 48 which divide the space between the gas permeable base 2 and the real bottom 42 into windboxes 50 to 55. The first outlet 6 has the chute 56 for conveying particulate material therefrom to a container 58. The second outlet 10 has the chute 60 for removing particulate material therefrom to a container 62.

The means 14 for feeding pressurized gas to substantially the whole area of the underside 16 of the base 2 comprises an air pump 64, main pipe 66 and branch pipes 68 to 73, which contain valves 74 to 80 respectively, for delivering pressurized air to the windboxes 50 to 55 respectively.

The paddles 24 to 37 are pivotally attached to the chain 18 by means not shown and weighted at the lower ends by weights not shown so that the paddles assume an approximately vertical position.

The electric motor 40 is coupled to the sprocket 22 by means of sprockets 82 and 84 and a chain 86.

In this embodiment the particulate material hopper 5 and chute 90 are provided for continuously feeding particulate material 92 to the container 1.

In operation the container 1 is loaded with particulate material 92 and the air pump 64 is actuated so that the container 1 is filled with fluidized particulate material to the level 94.

The electric motor 40 is started to move the paddles 32 to 37 in the direction Z and the valves 74 to 76 and 78 to 80 are used to adjust the air supply to the windboxes 50 to 55 so that the particulate material in the container 1 is more or less evenly fluidized therealong. The hopper 5 is used to continuously feed particulate material 92 to the container 1.

A vertical gradient of horizontal velocity is developed in the fluidized particulate material in the container 1. An upper portion of the fluidized bed comprising lighter particles of the particulate material is moved by the paddles 24 to 37 in the direction Z to cause a progressive enrichment of the fluidized bed in lighter particles towards the first end 8 which eventually flows out of the first outlet 6. A lower portion of the fluidized bed is moved to cause a progressive enrichment of the fluidized bed in heavier particles in the opposite direction to the direction Z, towards the second end 12 and flow out of the second outlet 10. Thus the particulate material is sorted so that a large proportion of lighter particles of the fluidized bed flow out of the first outlet 6 and are collected in the container 58 while a large proportion of the relatively heavier particles of the fluidized bed flow out of the second outlet 10 and are collected in the container 62.

It will be appreciated that the particulate material feed from the hopper 5 is made about the same as the sum of the discharges out of the first and second outlets 6 and 10 respectively.

In FIG. 2 similar parts to those shown in FIG. 1 are designated by the same reference numerals and the previous description is relied upon to describe them.

FIG. 2 shows the main parts of an apparatus that was used to verify the present invention and in this apparatus the container 1 was not provided with the first and second outlets 6 and 10 (FIG. 1) respectively but instead was provided with a removable cover 96 having a gas outlet 98. The chain 18 had sixteen paddles 100 to 115 which were weighted to remain more or less in vertical positions.

The chain 18 passed around sprockets 116 and 118 at each end, over and under intermediate sprockets 120 and 122 and on polytetrafluoroethylene support slides (not shown) which were attached to the side walls of the container 1. The container had eight windboxes 124 to 131 all fed with pressurized air in a similar manner to the windboxes shown in FIG. 1.

The container 1 was 2.44 m long by 203 mm wide by 710 mm high and depth of fluidized bed of approximately 300 mm was used. The width of the paddles 100 to 115 was 178 mm, and they dipped approximately 50 mm into the upper portion of the bed.

During operation of the apparatus a vertical gradient of horizontal velocity was developed in the fluidized particles by the paddles 100 to 115. The upper portions of the fluidized bed were caused to move parallel to the lower set of paddles 109 to 115, and the return, opposite flow in the lower part of the fluidized bed was facilitated by raising the end of the container 1 to which the paddles moved by a small angle $\alpha$. ($\alpha=0.9°$). The paddles moved the upper part of the fluidized bed from right to left, whereas the lower portions of the fluidized bed moved by gravity from left to right down the slight incline. In this manner, counter-current movement of 'flotsam' (upper) and 'jetsam' (lower) phases was established, while at the same time continuous interchange of material took place in a vertical direction throughout the fluidized bed. While fluidizing, the apparatus operated without feed or product removal, thus it operated at total reflux. (Reflux occurred at the two ends, where flotsam phase became jetsam phase—left end—and vice versa—right end.) The left end of the fluidized bed in this case corresponds to the distillate end of a distillation column, and the right end is analogous to the reboiler. In operation, the flotsam component of the bed accumulated at the left end (distillate or flotsam end), and conversely the jetsam component accumulated at the right end (reboiler or jetsam end). A counter-current cascade principle of operation resulted producing an appreciable difference in composition between the two ends of the device.

The separation of sand and activated carbon by this counter-current gas fluidized bed cascade principle was studied, under a variety of operating conditions and the following symbols are used to describe the tests and the results:

NOMENCLATURE $N_f$ = Fluidization number ($N_f = u/u_{mf}$)
$N_{f(s)}$ = Fluidization number based $u_{mf(s)}$ ($N_{f(s)} = u/u_{mf(s)}$)
$t_{ss}$ = Nominal time to attain steady state (s)
$u$ = Superficial gas velocity (m/s)
$u_{mf}$ = Minimum fluidization velocity (m/s)
$u_{mf(s)}$ = Minimum fluidization velocity of the sand (m/s)
$\bar{x}$ = Overall weight fraction of flotsam (carbon) in the fluidized bed
$x_b$ = Weight fraction of flotsam (carbon) at the jetsam end of the cascade
$x_d$ = Weight fraction of flotsam (carbon) at the flotsam end of the cascade
$\epsilon$ = Bed porosity
$\epsilon_p$ = Porosity of the carbon grains
$\tau$ = Time required for a paddle to travel one fluidized bed length (s)

The following Table 1 shows the principal physical characteristics of the two components used. The grain density is defined as the apparent density of individual grains of material. For sand, the grain density equals the density of silica, whereas for carbon the grain density equals the carbon skeletal density (1820 kg/m$^3$), multiplied by $(1-\epsilon_p)$, $\epsilon_p$ being the internal carbon porosity. $\epsilon_p$ was found from the increase in weight of carbon particles following temporary immersion in water, and from the specific gravity of water-saturated carbon, determined using a pycnometer.

TABLE 1

Physical characteristics of sand and carbon particles

| Property | Sand | Carbon |
|---|---|---|
| Sauter mean particle size (μm) | 91 | 1330 |
| Geometric standard deviation | 1.05 | 1.59 |
| Grain density (kg/m$^3$) | 2650 | 950 |
| $u_{mf}$(m/s) | 0.0113 | 0.457 |

The fluidized bed, of known overall composition, was first fluidized at $N_{f(s)}$ equal to 6 or 7, for approximately 30 minutes, so as to thoroughly mix the fluidized bed. Paddle motion was then started and the air flow rate was reduced until the desired value of $N_{f(s)}$ was attained over the central portions of the fluidized bed; $N_{f(s)}$ values of the two ends of the bed (over the two end windboxes 124 and 131) were however always maintained at 2 for mechanical reasons, since defluidization occurred rather easily when paddles came into proximity with the end walls of the fluidized bed. After a specified length of time the air flow was cut off, and approximately 10 kg of material was removed from each end of the fluidized bed. After sample reduction using a 16:1 Tyler sample splitter, the carbon and sand were separated by sieving and were separately weighed. The sampled material was then replaced from the end from which it had been taken, and the run was continued for a further length of time. This procedure was repeated until no further changes in composition of the two ends of the fluidized bed were observed. All runs were made at approximately ambient conditions. The air flow to the two end windboxes 124 and 131 was metered by rotameters; the air to the central windboxes 125 to 131 was metered by a single rotameter, after which the flow was split into six streams going to the six central windboxes 125 to 130 was maintained by observing pressure drop across calibrated flow resistances in the lines, and adjusting these flows within line valves.

Steady state results are shown in the following Table 2 where $t_{ss}$ equals the nominal time required to attain steady state; since steady state was approached asymptotically, $t_{ss}$ is defined as the time required for changes of less than 10% in the compositions at both ends of the cascade over an 8 minute period.

TABLE 2

Steady-state compositions observed at the two ends of the cascade.

| Paddle speed (mm/s) | $N_{f(s)}$ | $\bar{x}$(%) | $x_d$(%) | $x_b$(%) | $t_{ss}$ (min) |
|---|---|---|---|---|---|
| 20.3 | 1.1 | 2.0 | 9.8 | 0.07 | 40 |
| | 1.25 | | 8.0 | 0.17 | 32 |
| | 1.5 | | 7.8 | 0.21 | 24 |
| | 2.0 | | 7.5 | 0.41 | 16 |
| | 1.1 | 5.0 | 23.5 | 0.14 | 36 |
| | 1.25 | | 21.0 | 0.30 | 24 |
| | 1.5 | | 19.0 | 0.44 | 20 |
| | 2.0 | | 18.4 | 0.76 | 16 |
| | 1.1 | 7.5 | 33.5 | 0.31 | 36 |
| | 1.25 | | 33.0 | 0.33 | 32 |
| | 1.5 | | 32.4 | 0.53 | 24 |
| | 2.0 | | 23.1 | 0.64 | 16 |
| | 1.1 | 10.0 | 42.8 | 0.48 | 32 |
| | 1.25 | | 36.0 | 0.50 | 28 |
| | 1.5 | | 34.6 | 0.54 | 24 |
| | 2.0 | | 29.8 | 0.84 | 16 |
| | 1.1 | 15.0 | 40.3 | 0.93 | 20 |
| | 1.25 | | 42.4 | 0.80 | 16 |
| | 1.5 | | 41.2 | 0.94 | 20 |
| | 2.0 | | 42.8 | 1.72 | 16 |
| | 1.5 | 20.0 | 45.9 | 1.40 | 24 |
| | 2.0 | | 45.3 | 4.14 | 20 |
| 45.7 | 1.1 | 10.0 | 43.5 | 0.46 | 16 |
| | 1.25 | | 33.1 | 0.58 | 12 |
| | 1.5 | | 33.0 | 0.62 | 8 |
| | 2.0 | | 31.4 | 0.92 | 6 |

Clearly, $t_{ss}$ is an imprecisely measured quantity.

Figure 5:
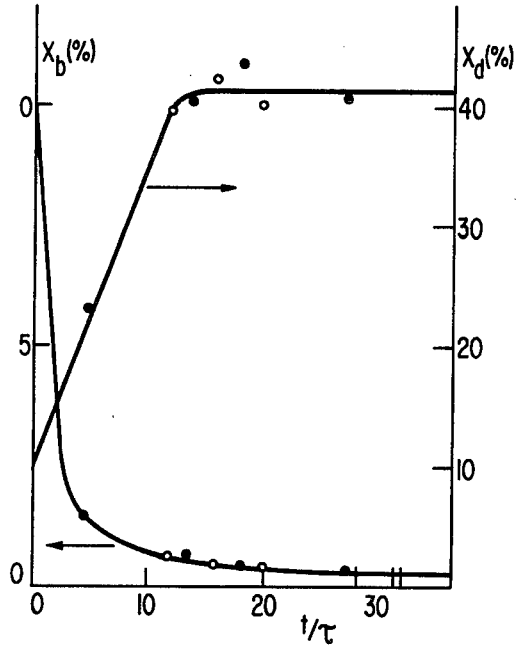

Typical rate of attainment of steady state data are shown in FIG. 5. It was found, when comparing data obtained with two different paddle speeds under otherwise similar conditions, that the data fell on one curve if time was non-dimensionalized by dividing it by $\tau$, the time required for a paddle to travel one fluidized bed length.

It is clear from the data in Table 2 that the method and apparatus according to the present invention is a very efficient device for separating carbon and sand. However, the separation of carbon from sand at the sand end ($x_b$) was much better than the separation of sand from carbon at the carbon end of the container. This may be due to the fact that the maximum overall carbon concentration was 20%, i.e. only jetsam-rich systems were studied. Difficulties were experienced in fluidizing carbon-rich systems, because the relatively larger $u_{mf}$ of carbon (Table 1) required a greater air flow rate than the air supply system was capable of providing. The excellent separation of carbon from sand at the jetsam end was remarkable inasmuch as Chiba, T., Nienow, A. W., and Rowe, P. N. Inst. Chem. Eng. Annual Res. Meet., Bradford, U.K. (1975) found that even 5 mm pieces of char did not float on top of a fluidized bed of much smaller ballotini; appreciable concentrations of char were observed throughout the fluidized bed.

The degree of separation observed always decreased with increasing values of $N_{f(s)}$, as expected, since improved mixing in a vertical direction reduces the partition factor k, and should therefore reduce overall separation in the fluidized bed.

Figure 1:
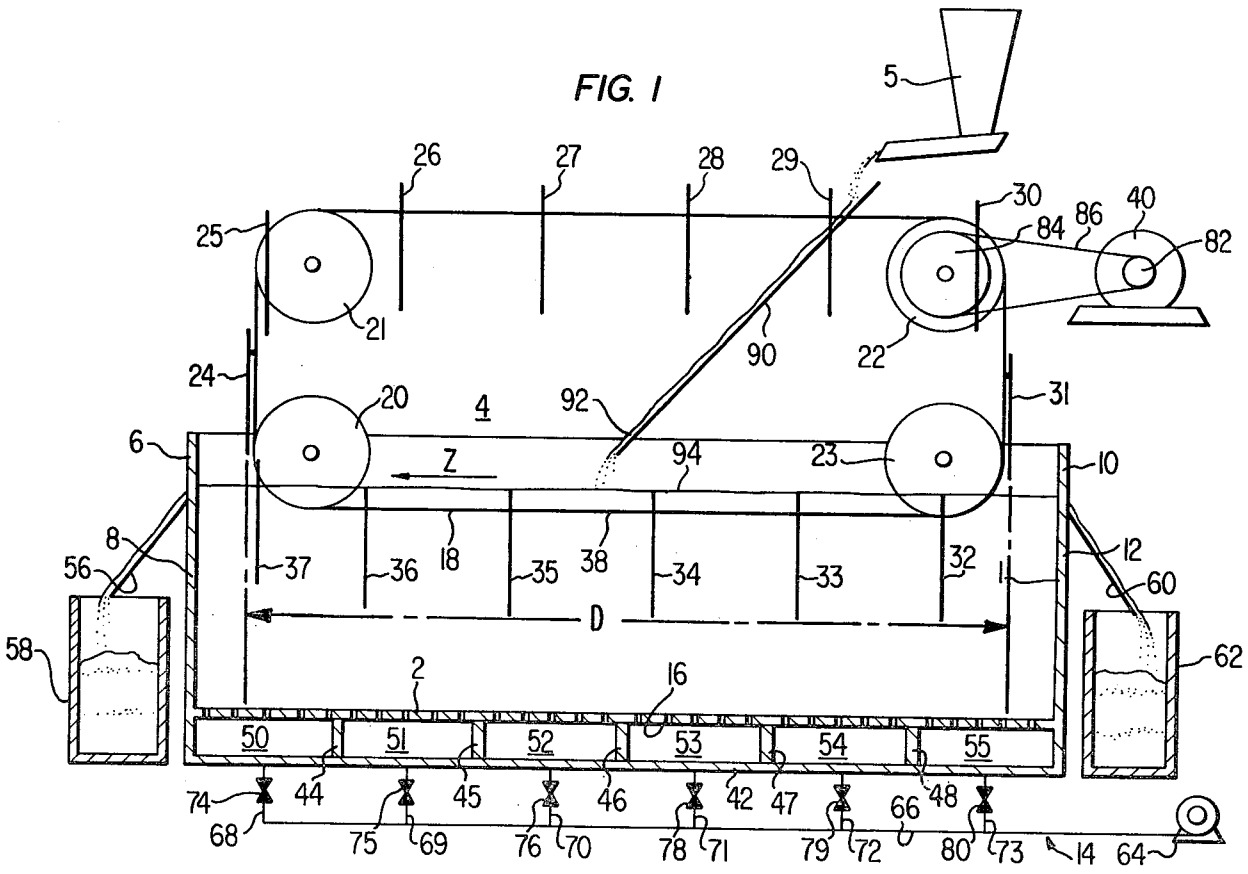
Figure 2:
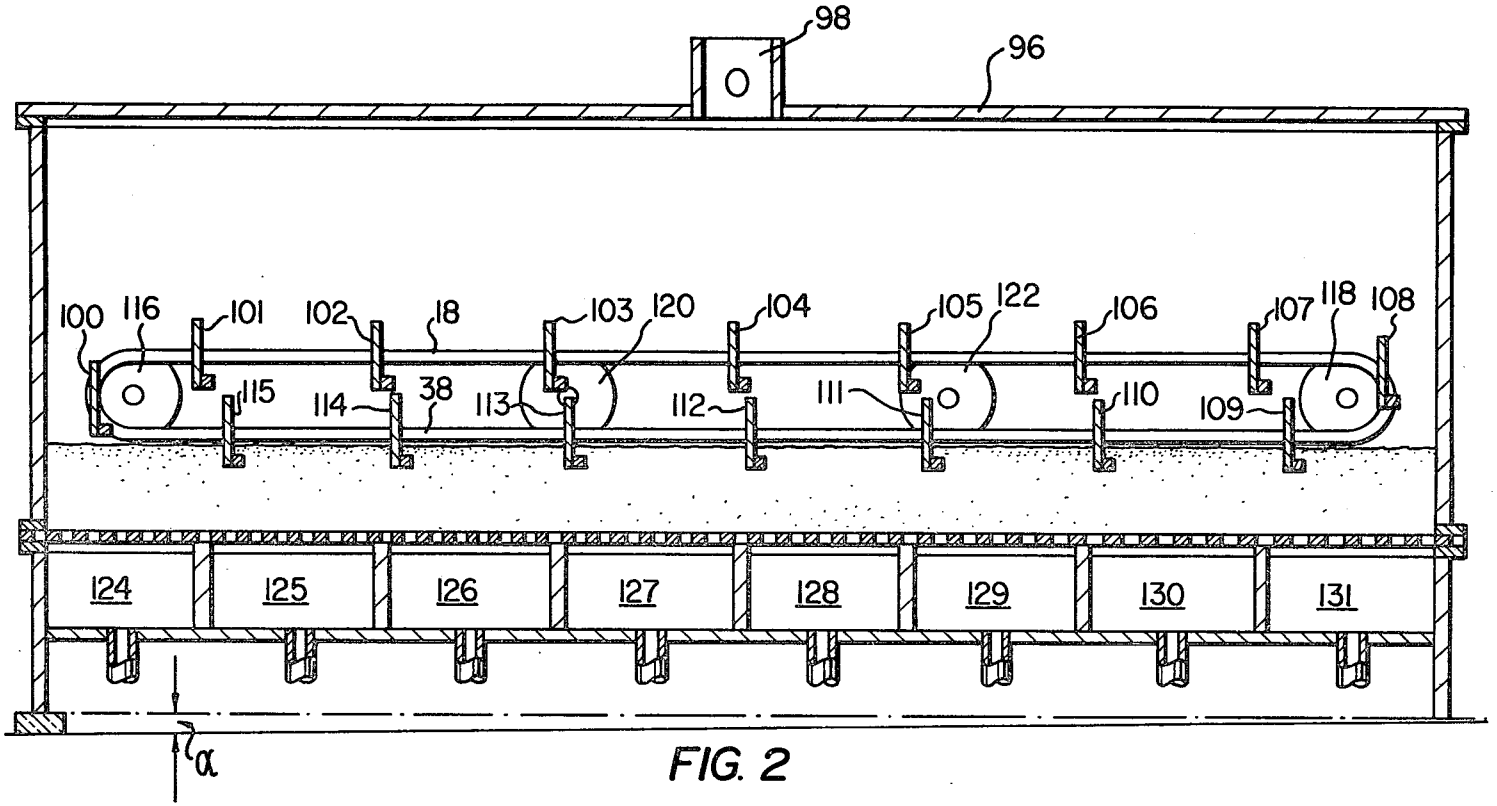
Figure 3:
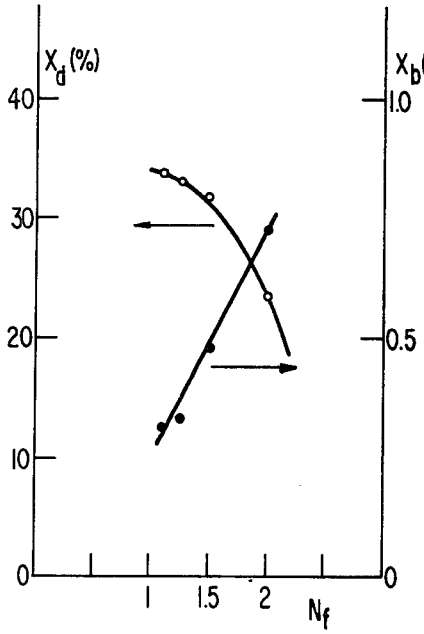
FIG. 3 shows plots of $x_d$ and $x_b$ as functions of $N_{f(s)}$, for a paddle speed of 20.3 mm/sec and $\bar{x}$ equal to 7.5%.
Figure 4:
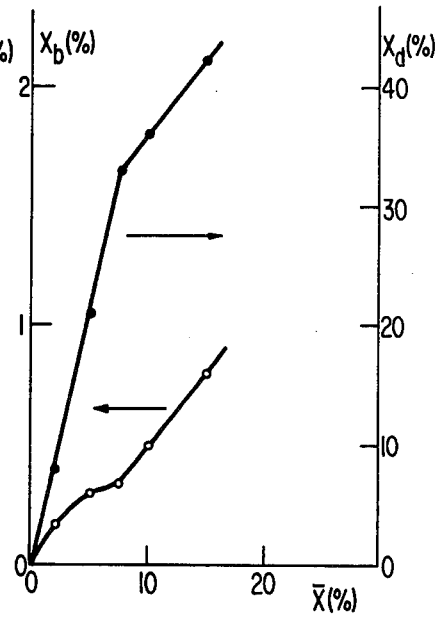
FIG. 4 shows plots of $x_d$ and $x_b$ as functions of $\bar{x}$, for a paddle speed of 20.3 mm/sec and $N_{f(s)}$ equal to 1.25.
Figure 6:
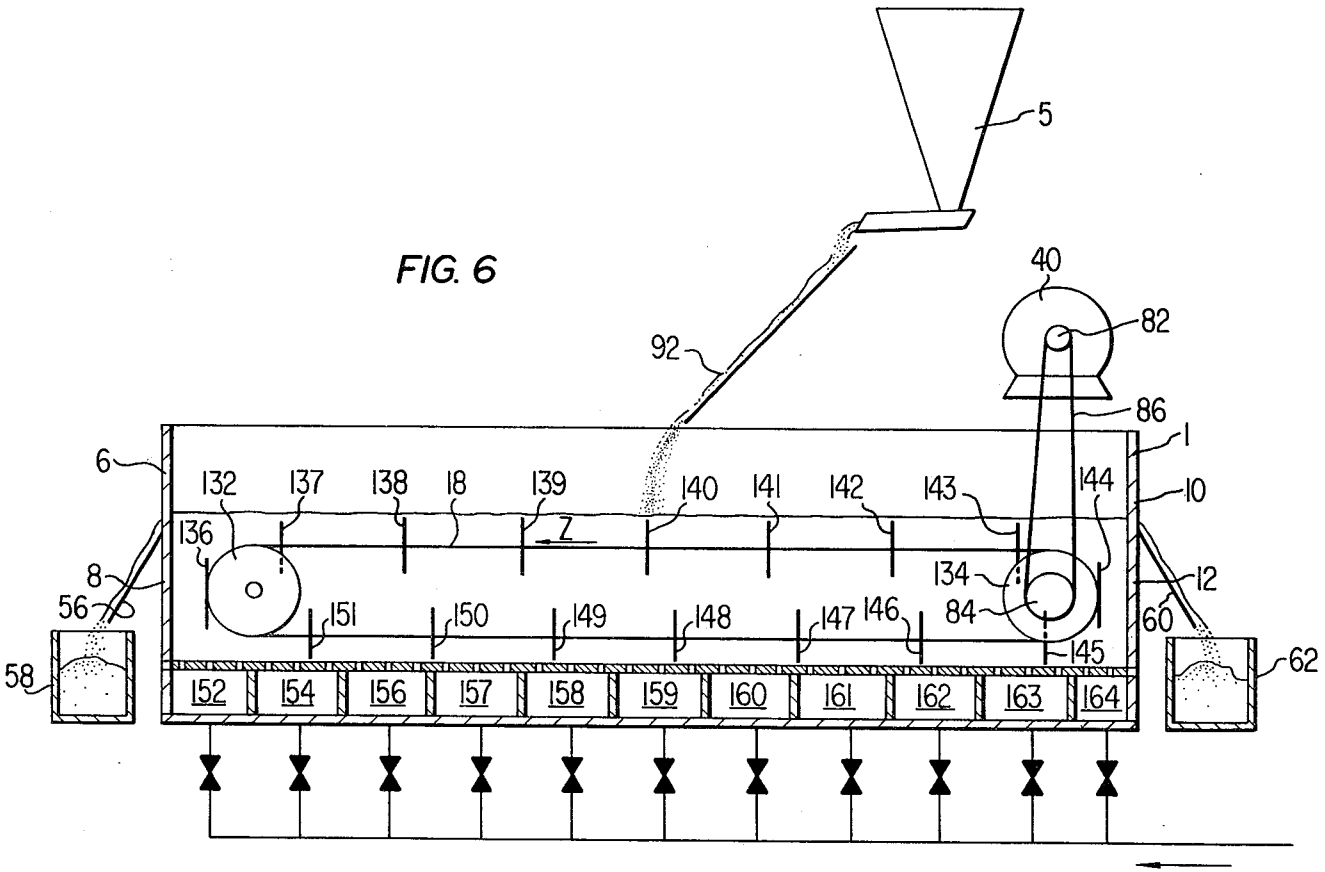

In FIG. 6 similar parts to those shown in FIG. 1 are designated by the same reference numerals and the previous description is relied upon to describe them.

In FIG. 6, the endless chain 18 passes around two sprockets 132 and 134, the sprocket 134 being attached to the sprocket 84. The endless chain 18 has sixteen paddles 136 to 151 all of which are weighted to remain more or less vertical and all of which are for immersion in the fluidized bed by being below the level of the first outlet 6. Eleven windboxes 152 to 164 are provided each fed with pressurized air in a similar manner to the windboxes 50 to 55 in FIG. 1.

In operation the endless chain 18 is driven so that the upper paddles 137 to 143 move in the direction Z. This causes the upper paddles 137 to 143 to move lighter particles of the fluidized bed towards the first end 8 while the lower paddles 145 to 151 move heavier particles of the fluidized bed towards the second end 12.

Figure 7:
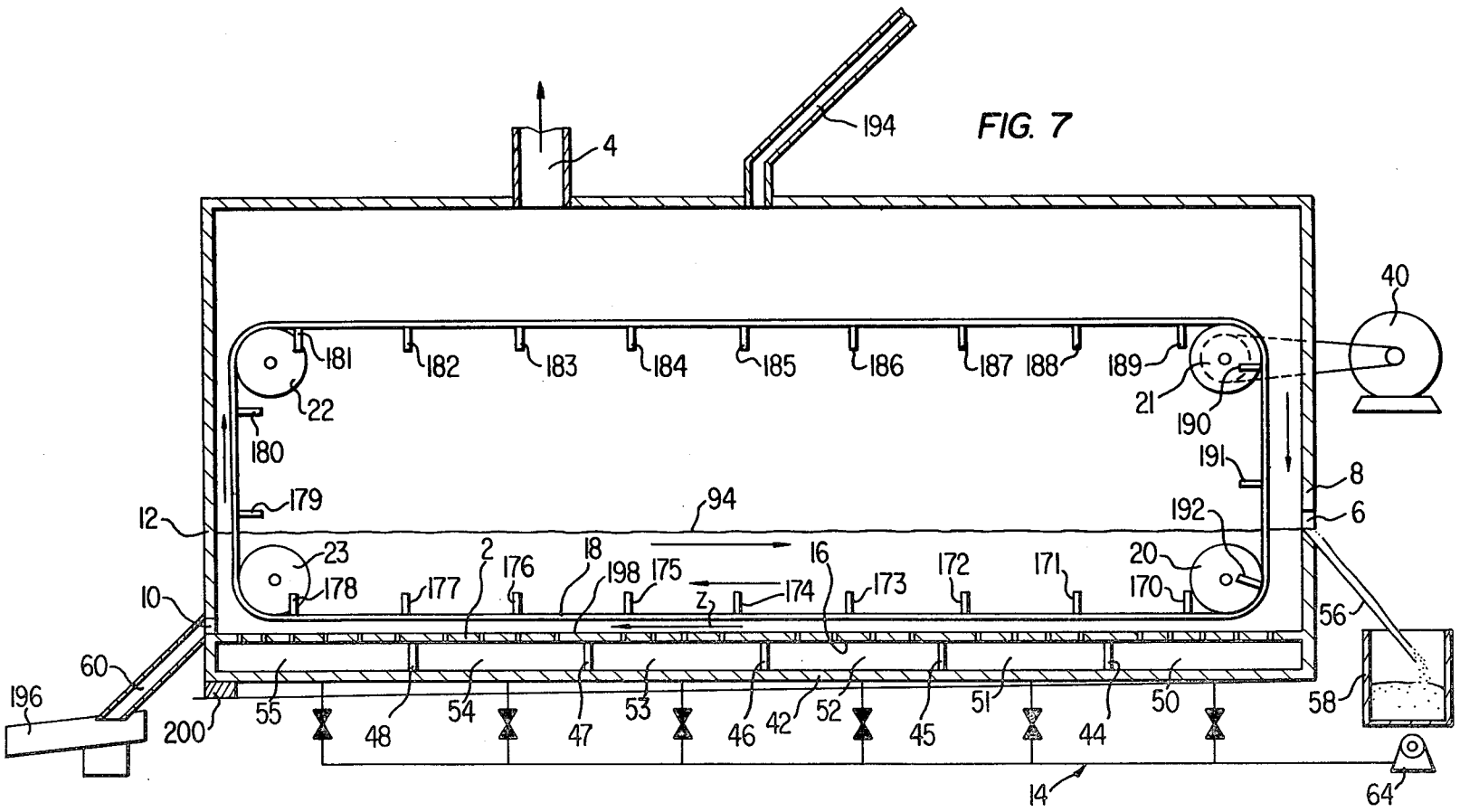

In FIG. 7 similar parts to those shown in FIG. 1 are designated by the same reference numerals and the previous description is relied upon to describe them.

In FIG. 7 there are twenty three paddles 170 to 192 which are rigidly attached to the endless chain 18 to extend substantially at right angles therefrom. The particulate material is fed to container 1 by means of a pipe 194 and the heavier particles are delivered by the chute 60 on to a vibratory feeder outlet 196. It should be noted that in this embodiment the second outlet 10 is located adjacent the gas permeable base 2.

Preferably the upper surface 198 of the gas permeable base 2 inclines downwardly in the direction of the means, in the form of outlet 6 and chute 56, for removing the particulate material from the first end 8 of the container 1. This is achieved in this particular embodiment by placing a spacer 200 under a portion of the container 1 adjacent the second end 10.

In operation the chain is driven so that the lower paddles 170 to 178 move in the direction Z and move the heavier particles in a lower portion of the fluidized bed towards the second end 10 and displace lighter particles in an upper portion of the fluidized bed towards the first end 8.

Further, in other embodiments instead of the weirs 6 and 10 the particulate material is removed mechanically by, for example, augers, bucket elevators, pipes and star valves or combinations of any of these with or without weirs.

I claim:

1. A method of sorting fluidized particulate material which comprises:

(a) feeding particulate material to an elongated, horizontally extending container having a gas permeable base and at least a major, intermediate lengthwise extending portion of the interior thereof for fluidized particulate material above the gas permeable base unobstructed by the container for the flow of fluidized particulate material therealong towards both a first end and a second end thereof, (b) fluidizing a bed of the particulate material in the container, (c) moving at least paddles attached to a lower side of a looped endless flexible member, along the container and only through the portion of the fluidized bed in the said at least major, intermediate lengthwise extending portion so that an upper portion of the fluidized bed is moved towards the first end while a lower portion of the fluidized bed is moved towards the second end thereby causing a progressive enrichment of the fluidized bed in lighter particles towards the first end with reflux of lighter particles therefrom, and a progressive enrichment of the fluidized bed in heavier particles towards the second end with reflux of heavier particles therefrom, (d) removing particulate material from the first end, and (e) removing particulate material from the second end.

2. A fluidized particulate material sorting apparatus, comprising:

(a) a particulate material fluidizing container which is elongated in a horizontal direction, has a base which is gas permeable over substantially the whole area thereof, at least a major, intermediate lengthwise extending portion of the interior thereof for fluidized particulate material above the gas permeable base unobstructed by the container for the flow of fluidized particulate material therealong, and an upper gas outlet, (b) means for feeding particulate material to the container, (c) means for removing particulate material from a first end of the container, (d) means for removing particulate material from a second, other end of the container, (e) means for feeding pressurized gas to substantially the whole area of the underside of the base, and wherein the improvement comprises, (f) an endless flexible member, (g) mounting means around which the endless flexible member is looped at each end with at least a lower side of the loop extending only along the said at least major, intermediate lengthwise extending portion of the container interior for movement therealong, (h) a plurality of paddles extending across at least a major portion of the container interior and facing the first and second ends and distributed along the length of the endless flexible member and attached thereto so that, in operation, the paddles along at least one side of the loop will be at least partially immersed in a fluidized bed in the container, and (i) driving means for driving the endless flexible member around the mounting means in a direction to move the said paddles along the container at a speed, whereby in operation, (j) a progressive enrichment of the fluidized bed in lighter particles occurs towards the first end with reflux of lighter particles therefrom, and a progressive enrichment of the fluidized bed in heavier particles occurs towards the second end with reflux of heavier particles therefrom.

* * * * *